US005709807A

United States Patent [19]

Yoshihara

[11] Patent Number: 5,709,807

[45] Date of Patent: Jan. 20, 1998

[54] FLOW RATE ADJUSTING FOR ROTARY NOZZLE TYPE MOLTEN METAL POURING UNIT

[75] Inventor: Tetsuya Yoshihara, Kanagawa-Ken, Japan

[73] Assignees: NKK Corporation; Tokyo Yogyo Kabushiki Kaisha, both of Tokyo; Nippon Rotary Nozzle Co., Ltd.; Kokan Kikai Kogyo Kabushiki Kaisha, both of Kawasaki, all of Japan

[21] Appl. No.: 745,897

[22] Filed: Nov. 7, 1996

Related U.S. Application Data

[63] Continuation of Ser. No. 416,643, Apr. 5, 1995, abandoned, which is a continuation-in-part of Ser. No. 32,456, Dec. 19, 1994, Pat. No. Des. 371,825, which is a continuation of Ser. No. 846,393, Mar. 4, 1992, abandoned.

[30] Foreign Application Priority Data

Sep. 5, 1991 [JP] Japan ..... 3-26602
Sep. 5, 1991 [JP] Japan ..... 3-26603

[51] Int. Cl.[6] ..... B22P 41/08

[52] U.S. Cl. ..... 222/600; 222/594

[58] Field of Search ..... 222/591, 597, 222/594, 600, 598; 266/236

[56] References Cited

U.S. PATENT DOCUMENTS

| | | | |
|---|---|---|---|
| D. 371,825 | 7/1996 | Yoshihara | D23/237 |
| 2,042,462 | 6/1936 | Hahn | 138/43 |
| 2,180,622 | 11/1939 | Vincent | 138/46 |
| 2,508,793 | 5/1950 | Miller | 138/43 |
| 2,948,296 | 8/1960 | Thorburn | 138/46 R |
| 4,354,932 | 10/1982 | McNeil | 138/41 R |
| 4,376,501 | 3/1983 | Hafner et al. | 222/600 |
| 4,431,028 | 2/1984 | Hendrick | 138/46 R |
| 4,577,785 | 3/1986 | Wakabayashi | 222/598 |
| 4,728,013 | 3/1988 | Winkelmann et al. | 222/598 |

FOREIGN PATENT DOCUMENTS

| | | | |
|---|---|---|---|
| 1-28343 | 8/1989 | Japan . | |
| 1-28344 | 8/1989 | Japan . | |
| 1-28345 | 8/1989 | Japan . | |
| 128346 | 8/1989 | Japan . | |
| 3 24301 | 4/1991 | Japan . | |
| 1-28342 | 4/1992 | Japan . | |
| 411298 | 4/1992 | Japan . | |
| 1417824 | 12/1975 | United Kingdom | 222/598 |

*Primary Examiner*—Scott Kastler
*Attorney, Agent, or Firm*—Ladas & Parry

[57] ABSTRACT

A flow rate adjusting plate for a rotary-nozzle-type molten-metal pouring unit has a shape in which one side or two sides of an octagon is or are replaced by one arc or two arcs. The arc or arcs are connected smoothly to adjacent straight sides. The plate has one hole or two holes for passing molten metal. The center of the hole corresponds to the center of the arc, and the distance between the arc and the hole is larger than the diameter of the hole.

20 Claims, 3 Drawing Sheets

PRIOR ART

FLOW RATE ADJUSTING FOR ROTARY NOZZLE TYPE MOLTEN METAL POURING UNIT

CROSS REFERENCE TO RELATED APPLICATIONS

This application is a continuation of application Ser. No. 08/416,643 filed on Apr. 5, 1995 , now abandoned, which is a continuation-in-part of U.S. Ser. No. 29/032,456 filed on Dec. 19, 1994 (now U.S. Pat. No. Des. 371,825) which is a continuation of U.S. Ser. No. 07/846,393 filed Mar. 4, 1992 now abandoned.

FIELD OF THE INVENTION

The present invention relates to a rotary nozzle type unit used to pour molten metal, and more particularly, it relates to a brick plate to control the pouring molten metal.

BACKGROUND OF THE INVENTION

A rotary-nozzle type unit for the pouring of molten metal can be provided with a pair of brick plates having at least one hole for the passing of the molten metal This pair of plates may include a fixed plate and a sliding plate and the sliding plate can be arranged to slide rotatably on the fixed plate 102. The control of pouring rate of the molten metal is achieved by adjusting the size of the passage cooperatively formed by the respective holes of the sliding plate and the fixed plate. These brick plates, therefore, form together a very important element of the rotary-nozzle.

An example of a brick plates used in a conventional nozzle is one which is formed into a regular octagon and has a hole to pass molten metal at an eccentric position. The octagon shape has the advantages of being able to cope with shock resulting from contact with molten metal and being able to prevent molten metal from entering between the sliding plate and the fixed plate. Such an arrangement has been mentioned in detail in Japanese patent No. 4-11298.

However, there is a problem related to such an octagon shaped brick plate. More specifically, the problem relates to the life expectancy of the brick plate and to the fact that liquid of high temperature causes thermal cracks around the hole in the plate. In general, such thermal cracks rapidly grow towards the thinnest portion of the plate. In case of the regular octagonal brick plate, the thermal cracks rapidly grow towards the side of the plate nearest to the hole because the brick plate has the narrowest span at this position. Consequently, this type of brick plate which is expensive and has to be changed at relatively short intervals results in a high cost of replacement.

BRIEF SUMMARY OF THE INVENTION

An object of the present invention is to solve the problem the mentioned above and to cut costs involved in replacement of brick plates.

The object is achieved by a flow rate adjusting plate having:

a periphery consisting of six straight sides and two arcs on opposite sides of the thusly constituted octagon with, said arcs connecting smoothly to the adjacent sides of said straight sides; and, for example, the plate being provided with two holes for passing molten metal, wherein the center of said holes corresponds to the respective center of said arcs, and the distance between said arcs and said holes is larger than the diameters of said holes.

The object of the invention is also achieved by a flow rate adjusting plate having:

a periphery consisting of seven straight sides and one arc which constitutes a side of an octagon with said arc connecting smoothly to the adjacent of said straight sides; and the plate being provided with one hole for passing molten metal, wherein the center of said hole corresponds to the center of said arc, and the distance between said arc and said hole is larger than the diameter of said hole.

In this way, the life of the invented plate is prolonged for 1.5–2 times that of a conventional brick plate. Accordingly, it brings about significant cost reduction. For example, an average factory has about ten rotary nozzle system. When the conventional brick plates are used, a pair of brick plates has to be changed every two operations due to the rapid growth of the thermal cracks which occur. This means that 40 brick plates have to be changed per day. The unit price of a conventional brick plate is about $200. Therefore, if there are 25 working days/month, (e.g., $200×40 pcs.×25 days) $200,000 will have to be expended as a cost every month. Besides, the labor cost for the exchange is estimated at about $50,000 ($100×20 pcs.×25 days). As a result, the total cost amounts to about $250,000. On the other hand, the brick plate of the present invention, which has about twice as long a life as the conventional brick plate, can cut the cost in half (namely to about, $125,000.)

DESCRIPTION OF THE PREFERRED EMBODIMENTS

Figure 7:
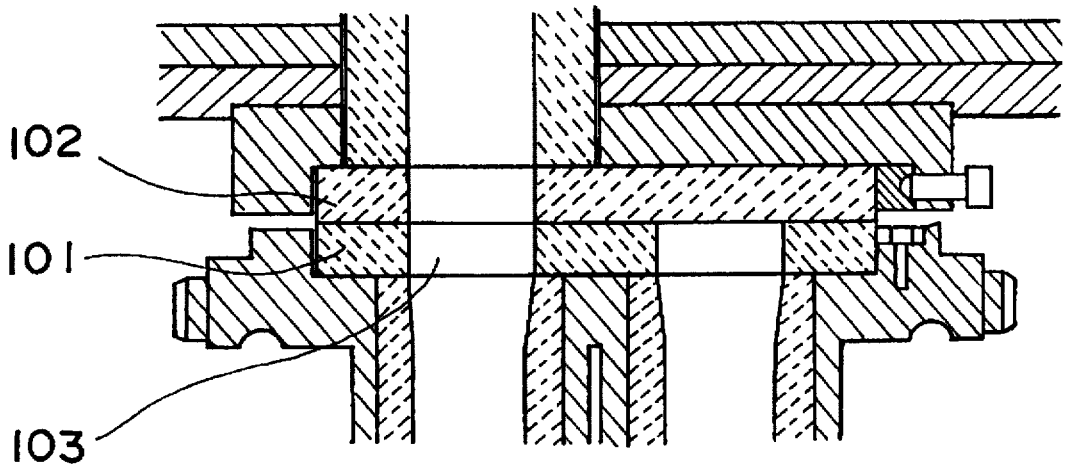
FIG. 7 is a sectional view of a conventional rotary-nozzle.

According to the prior art, a rotary-nozzle type unit for the pouring of molten metal can be provided with a pair of brick plates having at least one hole for the passing of the molten metal as shown in FIG. 7. This pair of plates may include a fixed plate and a sliding plate and the sliding plate 101 (see FIG. 7) can be arranged to slide rotatably on the fixed plate 102. The control of pouring rate of the molten metal is achieved by adjusting the size of the passage 103 cooperatively formed by the respective holes of the sliding plate 101 and the fixed plate 102. These brick plates, therefore, form together a very important element of the rotary-nozzle.

Figure 8:
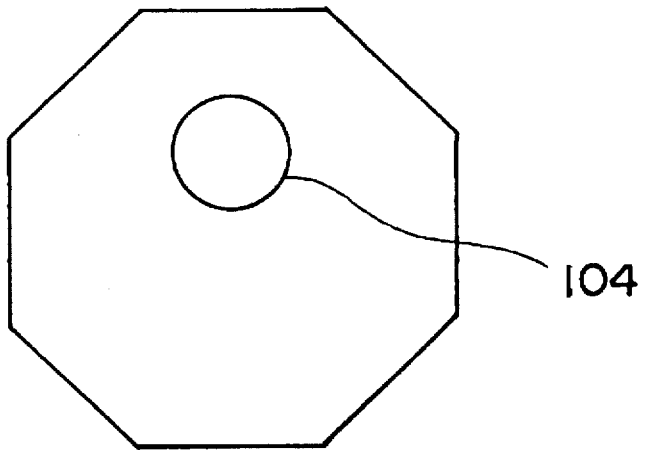
FIG. 8 is a plan view of a conventional brick plate.

An example of a brick plate used in a conventional nozzle is shown in FIG. 8. This brick plate is formed into a regular octagon and has a hole 104 to pass molten metal at an eccentric position. The octagon shape has the advantages of being able to cope with shock resulting from contact with molten metal and being able to prevent molten metal from penetrating between the sliding plate and the fixed plate.

However, there is a problem related to such an octagon shaped brick plate. In a regular octagonally shaped brick plate as shown in FIG. 8, thermal cracks rapidly grow towards the side of the plate nearest to the hole 104 because the brick plate has the narrowest span at this position. Consequently, this type of brick plate which is expensive and has to be changed at relatively short intervals results in a high cost of replacement.

Figure 2:
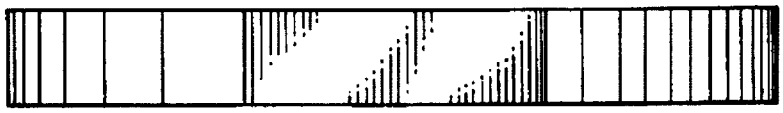
FIG.2 is a front view of the first embodiment of the present invention as illustrated in FIG. 1.
Figure 1:
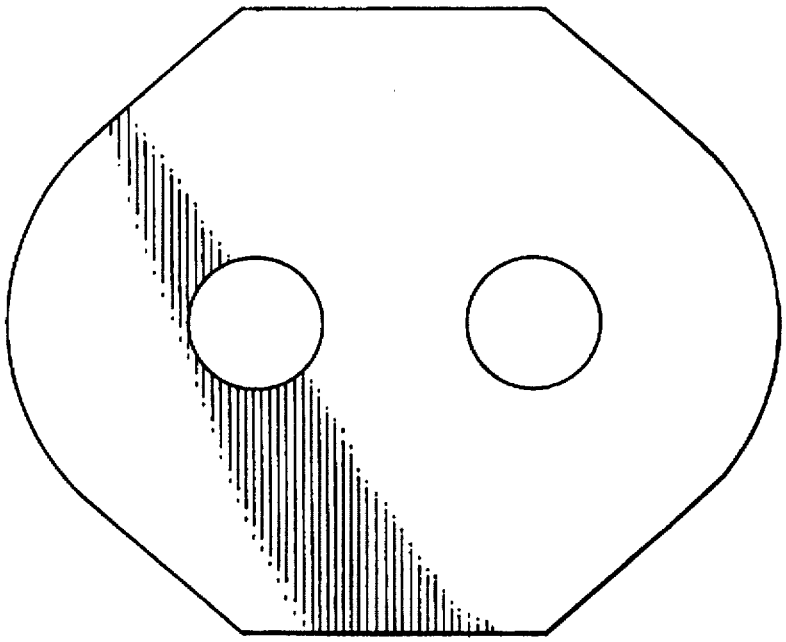
FIG. 1 is a plan view of a first embodiment of the present invention.
Figure 3:
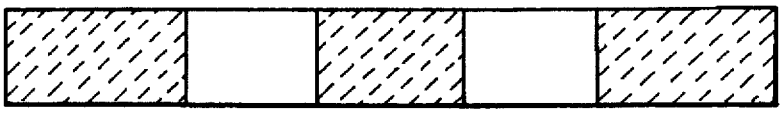
FIG. 3 is a sectional view of the first embodiment of the present invention.

A first embodiment of the invention is shown in FIGS. 1–3. This plate is made as brick. The plate has a shape of a regular octagon in which two opposite sides were replaced by arcs. Thus, the plate has a periphery which consists of six straight or planar sides arranged in groups of three and two arcs connecting the groups. These arcs merge smoothly with the adjacent straight sides. The straight sides represent planar side faces and the arcs represent arcuate side faces.

The plate also has two holes for passing molten metal. The holes have same diameter, and the center of each of the holes corresponds to the center of the corresponding arcs. A feature is that the distance between each arc and the edge of each hole is larger than the diameter of said holes.

Figure 5:
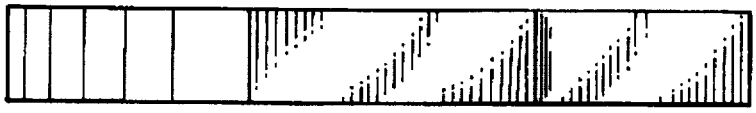
FIG. 5 is a front view of the second embodiment of the present invention.
Figure 4:
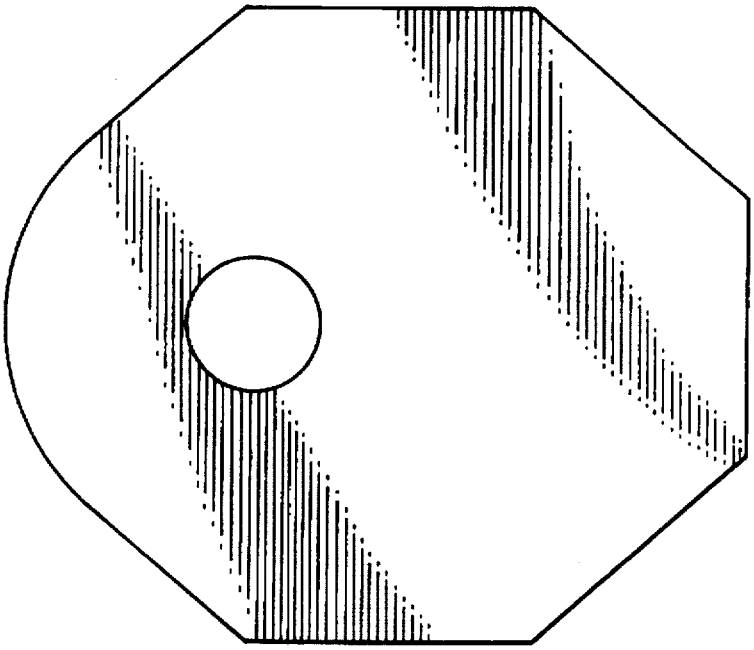
FIG. 4 is a plan view of a second embodiment of the present invention.
Figure 6:
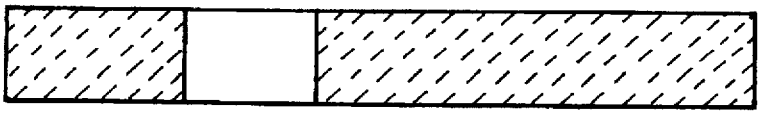
FIG. 6 is a sectional view of the second embodiment of the present invention.

A second embodiment is shown in FIGS. 4–6. This plate is also made of brick and has a shape in which one side of a regular octagon is replaced by an arc. Thus, the plate has a periphery which consists of seven straight sides and one arc. The arc merges smoothly with the adjacent straight sides.

In addition, this plate has a single hole for passing molten metal. The center of the hole corresponds to the center of the arc. The distance between the arc and the edge of the hole is larger than the diameter of the hole as in the first embodiment.

Generally it will be noted that the invention provides a flow rate adjusting plate having opposite top and bottom generally planar surfaces having centers defining an axis of the plate. Peripheral side faces are arranged successively about and generally continuously connecting the top and bottom surfaces. Each of the side faces subtends a common segment angle about the axis of the plate. At least a first hole extends through the plate from the top surface to the bottom surface. This first hole has an axis spaced from axis of the plate. At least the aforesaid side face is generally convexly arcuate relative to the axis of the plate and has an axis at least substantially coincident with the axis of the first hole. At least two of the side faces are successively adjacent opposite ends of the first arcuate side and are generally planar. The axis of the first hole is spaced from the axis of the plate generally toward the first arcuate side face. According to another embodiment a second one of the side faces is generally arcuate relative to the axis of the plate. Where there are first and second arcuate side faces, these are preferably opposite each other across the top and bottom surfaces.

These plates are set in pairs respectively into a nozzle and used to control the pouring of molten metal as is done with conventional plates. (The Japanese Patent No. 4-11298 indicates the detail of the attachment of the conventional type of plate). An advantage of the new plates over conventional plates is that the life of the new plates is 1.5–2 times as much as that of the conventional plates. To accomplish this the distance between the arc and the edge of the hole is larger than the diameter of the hole and the distance is constant. These new plates provide excellent endurance in addition to the excellent functions of a regular octagonal plate.

In the aforegoing, it will also be noted that the axes of the hole or holes, plates and the center of curvature of the arcuate side or sides are all arranged on a straight line and are perpendicular to the top and bottom surfaces of the plates and are accordingly parallel.

What is claimed is:

1. A flow rate adjusting plate for a rotary-nozzle molten-metal pouring unit, said plate comprising a body generally in the shape of an octagon and having a periphery including six straight sides connected in groups of three and two arcs, said arcs being at opposite sides of said octagon with said arcs between and connecting said groups to complete said octagon, said arcs connecting smoothly to adjacent of said straight sides; and said body being provided with two holes for passing said molten metal, each of said holes having a center which is substantially the same as the center of one of said arcs, said arcs and said holes being spaced apart by a distance which is larger than the diameter of said holes.

2. A flow rate adjusting plate for a rotary-nozzle molten-metal pouring unit, said plate comprising:

a body generally in the shape of an octagon and having a periphery including seven straight sides connected in series and one arc at a further side of said octagon with said arc connecting smoothly to adjacent of said straight sides; and said body being provided with one hole for passing said molten metal, said hole having a center which is substantially the same as the center of said arc, said arc and said hole being spaced by a distance which is larger than the diameter of said hole.

3. In a flow rate adjusting plate having opposite top and bottom generally planar surfaces having centers defining an axis of the plate, peripheral side faces arranged successively about and generally continuously connecting the top and bottom surfaces, each of the side faces subtending a common segment angle about the axis of the plate, and at least a first hole extending through the plate from the top surface to the bottom surface, the first hole having an axis spaced from the axis of the plate, wherein:

at least a first one of the side faces is generally convexly arcuate relative to the axis of the plate and has an axis at least substantially coincident with the axis of said first hole;

at least two of the side faces are successively adjacent opposite ends of the first arcuate side face and are generally planar; and the axis of the first hole is spaced from the axis of the plate generally toward the first arcuate side face.

4. In the plate according to claim 3, wherein:

a second one of the side faces is generally arcuate relative to the axis of the plate.

5. In the plate according to claim 4, wherein:

the first and second arcuate side faces are opposite each other across the top and bottom surfaces;

at least two of the side faces are successively adjacent opposite ends of the second arcuate side face and generally planar; and a second hole extends through the plate from the top surface to the bottom surface, the second hole having an axis which spaced from the axis of the plate generally toward the second arcuate side face.

6. In the plate according to claim 3, wherein:

the axis of the plate, the axis of the first hole and an axis of each of the arcuate side faces are parallel.

7. In the plate according to claim 5, wherein:

the axis of the plate, the axis of the first hole and second holes and the axes of each of the arcuate side faces are parallel.

8. In the plate according to claim 3, wherein:

the axis of the plate is perpendicular to each of the top and bottom surfaces.

9. In the plate according to claim 5, wherein:

the axis of the plate is perpendicular to each of the top and bottom surfaces.

10. In the plate according to claim 6, wherein:

the axis of the plate is perpendicular to each of the top and bottom surfaces.

11. In the plate according to claim 7, wherein:

the axis of the plate is perpendicular to each of the top and bottom surfaces.

12. In the plate according to claim 3, wherein:

the axis of the plate, the axis of the first hole and the center of curvature of the first arcuate side face are on a straight line.

13. In the plate according to claim 6, wherein:

the axis of the plate, the axis of the first hole and the center of curvature of the first arcuate side face are on a straight line.

14. In the plate according to claim 10, wherein:

the axis of the plate, the axis of the first hole and the center of curvature of the first arcuate side face are on a straight line.

15. In the plate according to claim 5, wherein:

the axis of the plate, the axes of the first and second holes and the centers of curvature of the first and second arcuate side face are on a straight line.

16. In the plate according to claim 7, wherein:

the axis of the plate, the axes of the first and second holes and the centers of curvature of the first and second arcuate side face are on a straight line.

17. In the plate according to claim 11, wherein:

the axis of the plate, the axes of the first and second holes and the centers of curvature of the first and second arcuate side face are on a straight line.

18. In the plate according to claim 3, wherein the improvements further comprise having eight side faces.

19. In the plate according to claim 5, wherein the improvements further comprise having eight side faces.

20. In the plate according to claim 17, wherein the improvements further comprise having eigh side faces.

* * * * *

UNITED STATES PATENT AND TRADEMARK OFFICE

CERTIFICATE OF CORRECTION

PATENT NO. : 5,709,807
DATED : January 20, 1998
INVENTOR(S) : Tetsuya YOSHIHARA

It is certified that error appears in the above-indentified patent and that said Letters Patent is hereby corrected as shown below:

On the title page, item [54] and col 1, line 1 after "ADJUSTING" insert --PLATE--.

Signed and Sealed this

Fifth Day of May, 1998

*Attest:*

*Attesting Officer*

BRUCE LEHMAN

*Commissioner of Patents and Trademarks*